US008416551B2

(12) United States Patent
Plaideau

(10) Patent No.: US 8,416,551 B2
(45) Date of Patent: Apr. 9, 2013

(54) STARTER FOR THERMAL ENGINE EQUIPPED WITH ELECTRONIC CONTROL DEVICE

(75) Inventor: Stéphane Plaideau, Rochetoirin (FR)

(73) Assignee: Valeo Equipments Electriques Moteur, Creteil (FR)

( * ) Notice: Subject to any disclaimer, the term of this patent is extended or adjusted under 35 U.S.C. 154(b) by 126 days.

(21) Appl. No.: 13/102,148

(22) Filed: May 6, 2011

(65) Prior Publication Data

US 2011/0273811 A1 Nov. 10, 2011

(30) Foreign Application Priority Data

May 7, 2010 (FR) ..... 10 53594

(51) Int. Cl.
*H01H 47/00* (2006.01)

(52) U.S. Cl.
USPC ..... 361/139

(58) Field of Classification Search ..... 361/139
See application file for complete search history.

(56) References Cited

U.S. PATENT DOCUMENTS

| | | | | |
|---|---|---|---|---|
| 4,606,307 | A * | 8/1986 | Cook | 123/179.2 |
| 5,949,151 | A * | 9/1999 | Nakajima | 307/10.3 |
| 5,951,440 | A * | 9/1999 | Reichlinger | 477/167 |
| 2008/0127927 | A1 * | 6/2008 | Hirning et al. | 123/179.3 |

FOREIGN PATENT DOCUMENTS

| | | |
|---|---|---|
| EP | 1 041 277 | 10/2000 |
| EP | 1 203 884 | 5/2002 |
| FR | 2 611 981 | 9/1988 |
| FR | 2 913 727 | 9/2008 |

* cited by examiner

*Primary Examiner* — Jared Fureman
*Assistant Examiner* — Kevin J Comber
(74) *Attorney, Agent, or Firm* — Berenato & White, LLC

(57) ABSTRACT

A starter including a double contact electromagnetic contactor (10) having an electrically controllable micro-actuator of the micro-solenoid type and an associated electronic control device (ECC). The electronic control device includes a first transistor commutation (T1, T2, CZ2, RC1, RC3, SL) to control the excitation of a pull-in winding ($L_a$) of the contactor and a second transistor commutation (T3, CZ2, RC2) to control the excitation of the micro-actuator. The second transistor commutation controls the excitation of the micro-actuator (MS) for a predetermined duration after activation of the electronic control device.

13 Claims, 8 Drawing Sheets

STARTER FOR THERMAL ENGINE EQUIPPED WITH ELECTRONIC CONTROL DEVICE

This application is a US Utility Patent Application, and claims priority to French Patent Application Number 10/53594 filed May 7, 2010.

FIELD OF THE INVENTION

In a general way the invention relates to the field of starters for thermal engines in motor vehicles. More particularly, the invention relates to a starter equipped with an electronic control device.

BACKGROUND OF THE IN

Starters comprising double contact electromagnetic contactors are known in the state of the art. Such a starter la according to the prior art, including a contactor 10*a*, is described below with reference to FIG. 1.

The contactor 10*a* comprises a housing 104 in which a plunger core 100 moves in a translatory manner, the front end 101 of which is provided with a finger 1010. The rear end of the plunger core 100 actuates two moving contact plates CM1 and CM2, designed to establish galvanic contact between contact terminals C11, C12 and C21, C22. A core return spring 103 is disposed between the housing and the front end 101 of the plunger core 100 and exerts a restoring force counteracting a translatory movement of the latter towards the rear.

The contactor 10*a* also comprises two windings, $L_m$ and $L_a$, having a common end. Another end of the winding $L_m$ is connected to an electrical mass M (conventionally the chassis of the vehicle). Another end of the winding $L_a$ is connected to the terminals C12, C22 and an electrical brush B1. The end common to both windings $L_m$ and $L_a$ is connected to the positive terminal ("B+") of a battery 12 via a starting contact 13 of the vehicle (or any element acting in a similar way). The terminal C11 is directly connected to the positive terminal B+ of the battery 12. The terminals C21 is connected to the positive terminal of the battery 12 through a current limit resistance RD.

The starter 1*a* comprises an electric motor 11. This motor 11 traditionally consists of an armature or rotor 110 (winding L3) and an inductor or stator 114 which can comprise permanent magnets. The armature 110 is conventionally energised via a collector ring 115, disposed at the rear of the motor 11, and two brushes B1 and B2, the brush B1 designated positive being connected to the terminals C12, C22 and the brush B2 designated negative being connected to the mass M.

A starter is disposed in front of the motor 11, said starter here comprising a starter gear unit 113, free wheel 112, meshing spring 115 and a pulley (not referenced) in which a fork 15 is engaged. A spiral ramp 111 is also provided in front of the motor 11. The contactor 10*a* and the motor 11 are mechanically coupled by the fork 15 moving around an axis of rotation Δ1. As it appears in FIG. 1, the upper end of this fork 15 is carried along by the finger 1010. The lower end of the fork 15 is mechanically coupled in the region of the starter pulley at the rear of the engagement spring 115, itself disposed between this lower end and the free wheel 112.

When the driver of the vehicle actuates the starting contact 13, the electric current then circulates in the windings $L_m$ and $L_a$ of the contactor 10, the connection to the mass M of the winding $L_a$ being through the motor 11. An electromagnetic force then builds up in the contactor 10*a* which causes the core 100 to be attracted to the rear (arrow $f_1$). The spring 103 is compressed and exerts a counteractive restoring force. The plunger core 100 drives the fork 15 rotationally around the axis Δ1 and the lower end of the latter in its turn drives the spring unit 115, free wheel 112 and gear 113 forwards (arrow $f_2$).

When the plunger core 100 of the contactor 10*a* reaches an intermediate point in its travel, the moving contact plate CM1 short-circuits the contact terminals C11 and C12 (closed position), the contact terminals C21 and C22 themselves remaining not short-circuited (open position). The contact terminals C11 and C12 in the closed position, through the current limit resistance RD, connect the positive brush B1 to the positive terminal B+ of the battery 12 and energise the motor 11, the electrical circuit being closed again by the negative brush B2. The armature 110 (rotor) of the motor 11 starts to turn around its axis of rotation Δ2 with reduced power, that is to say, at reduced speed and torque, due to the current being limited by the resistance RD, which also causes a rotation R of the gear 113. Set in motion by a double translational (arrow $f_2$) and rotational R movement, the gear 113 approaches the toothed crown 14 of the thermal engine.

In a more precise way, two cases can then occur:

1) The gear 113 directly meshes with the crown 14 in its translational movement (arrow $f_2$) and the plunger core 100 will continue its translational movement until it reaches the end of its travel.

2) A tooth of the gear 113 butts against a tooth of the crown 14, which also tends to block the travel of the plunger core 100. The starter spring 115 allows the plunger core 100 to continue its advance, since this spring 115 is compressed, the pulley being able to slide on the shaft. The drive of the gear 113 by the motor 11 at reduced speed prevents damage to the teeth of the gear 113 and of the crown 14 on account of a so-called "milling" effect. As a result of its rotational and translational movements, the gear 113 ends up meshing with the crown 14 and the plunger core 100 continues its translational movement until it reaches the end of its travel.

When the plunger core 100 of the contactor 10*a* has reached the end of its travel, the moving contact plate CM2 short-circuits the contact terminals C21 and C22 (closed position), the contact terminals C11 and C12 remaining in the closed position. The contact terminals C21 and C22 in the closed position directly connect the positive brush B1 to the positive terminal B+ of the battery 12. The motor 11 is then supplied with full power and turns the thermal engine for a starting operation.

In the situation above, the pull-in winding $L_a$ is short-circuited since there is no longer any difference in potential between the end common to both windings, $L_m$ and $L_a$, and the contact C21-C22 are both connected to the positive terminal of the battery 12. The moving contact plates CM1 and CM2 are held in the closed position by the holding winding $L_m$, acting upon the plunger core 100 and the core return spring 103.

When the driver breaks the starting circuit by opening the starting contact 13, the electromagnetic force which has been building up in the contactor 10*a* ceases, the holding winding $L_m$ no longer being energised. The plunger core 100 is returned to its rest position by the spring 103 and the electrical connection between battery 12 and motor 11 is broken. The motor 11, no longer being energised, ceases to turn the gear 113. Moreover, since the plunger core 100 returns to its initial position (towards the rear), it acts upon the fork 15 which disengages the gear 113 from the crown 14.

On the other hand, if the driver maintains the starting contact 13 in the closed position longer than necessary, the thermal engine of the vehicle starts to operate, the gear 113, therefore the armature 110 of the motor 11, is consequently subjected to a very high rotational speed (typically, in the case of a thermal engine rotating at 3,000 rpm, the rotational speed of the gear will reach 25,000 rpm, the reduction gear ratio between "crown-motor" generally ranging between 8:1 and 16:1). To prevent the centrifugation of the motor 11, it is therefore necessary to disconnect the starter shaft from the gear 113. This is the role allocated to the free wheel 112.

In the contactor 10*a* of FIG. 1, closing of the contact C11-C12 prior to that of the contact C21-C22, allowing the motor 11 to function in two distinct modes of operation as described above, is introduced by different tarings of contact springs P1, P2 and P3.

This prior art solution is satisfactory overall. However, it is desirable to propose improvements offering additional degrees of freedom in the design of a starter of the type described, particularly in terms of controlling the interval between closing of the contacts during a starting operation.

SUMMARY OF THE INVENTION

For this purpose, the applicant proposes, in its French patent application filed jointly with the present application, a new double contact electromagnetic contactor design incorporating an electrically controllable micro-actuator. More precisely, this contactor comprises a plunger core, a first pull-in winding, a second holding winding, a mobile contact plate, first, second and third contacts and the electrically controllable micro-actuator, the contactor having three operating states: a first state with no electrical contact between the contacts, a second state with electrical contact between the first and second contacts and a third state with electrical contact between the first, second and third contacts.

In such a contactor, the micro-actuator makes it possible, depending on an electric current which is applied thereto, to allow or prohibit commutation between the second and third operating states of the contactor.

The present invention relates to a starter for thermal engines comprising the association of a double contact electromagnetic contactor having an electrically controllable micro-actuator of the micro-solenoid type and an electronic control device, said electronic control device comprising first transistor commutation means to control the excitation of a pull-in winding of the contactor and second transistor commutation means to control the excitation of the micro-actuator.

According to another feature, the second transistor commutation means control the excitation of the micro-actuator for a first predetermined duration after activation of the electronic control device.

Advantageously, the electrically controllable micro-actuator allows the interval between the second and third operating states of the contactor to be adjusted. It therefore becomes possible to better regulate the control sequencing of a starter and to easily adapt this sequencing to the various applications of the starter.

According to one particular embodiment, the second transistor commutation means comprise at least one transistor of the MOSFET type.

According to one particular feature of the invention, the second transistor commutation means comprise a first RC circuit with time-constant for the first predetermined duration. Preferably, the first RC circuit with time-constant is a circuit of the differentiating type.

According to another particular feature of the invention, the second transistor commutation means comprise a first voltage stabiliser circuit supplying a first stabilised voltage feeding the second transistor commutation means.

According to yet another particular feature of the invention, the first transistor commutation means comprise at least one transistor of the MOSFET type.

According to one particular embodiment, the first transistor commutation means comprise second and third RC circuits with time-constant of the integrating type, the second RC circuit controlling commutation to start activation of the first transistor commutation means and the third RC circuit controlling commutation to end activation of the first transistor commutation means, activation of the first transistor commutation means producing the excitation of the pull-in winding.

According to another particular feature of the invention, the first predetermined duration is completed between commutation to start activation and commutation to end activation of the first transistor commutation means.

The starter according to the invention is particularly suitable for applications in motor vehicles equipped with the automatic "stop/start" or "stop & go" function of the thermal engine.

The invention will now be described in more detail through particular embodiments of the latter, with reference to the appended drawings, wherein:

DESCRIPTION OF THE PREFERRED EMBODIMENT

With reference to FIGS. 2-8, a particular embodiment of a starter with double contact according to the invention is now described.

Figure 1:
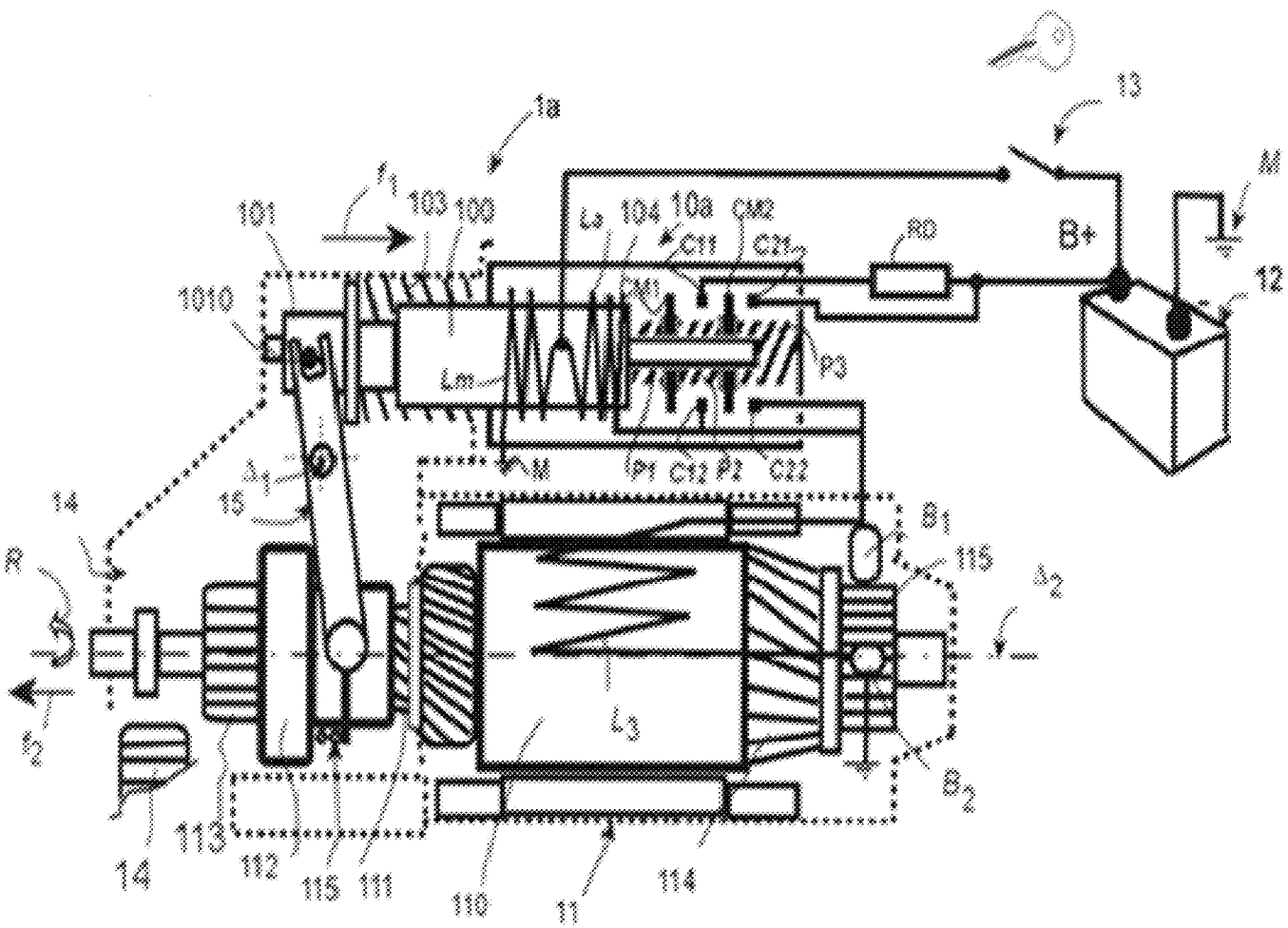
FIG. 1 schematically illustrates a starter comprising a double contact contactor according to the prior art.

The general configuration of a starter according to the invention reiterates the essence of the configuration described in respect to FIG. 1, that is to say a general configuration, in itself, according to the prior art. Compared to this, the invention has an additional advantage because it does not require substantial modifications and remains compatible with the technologies presently used within the automotive industry.

Also hereinafter, components common to FIG. 1, or at the very least playing a similar role, have the same references and will only be described when and where necessary.

Figure 2:
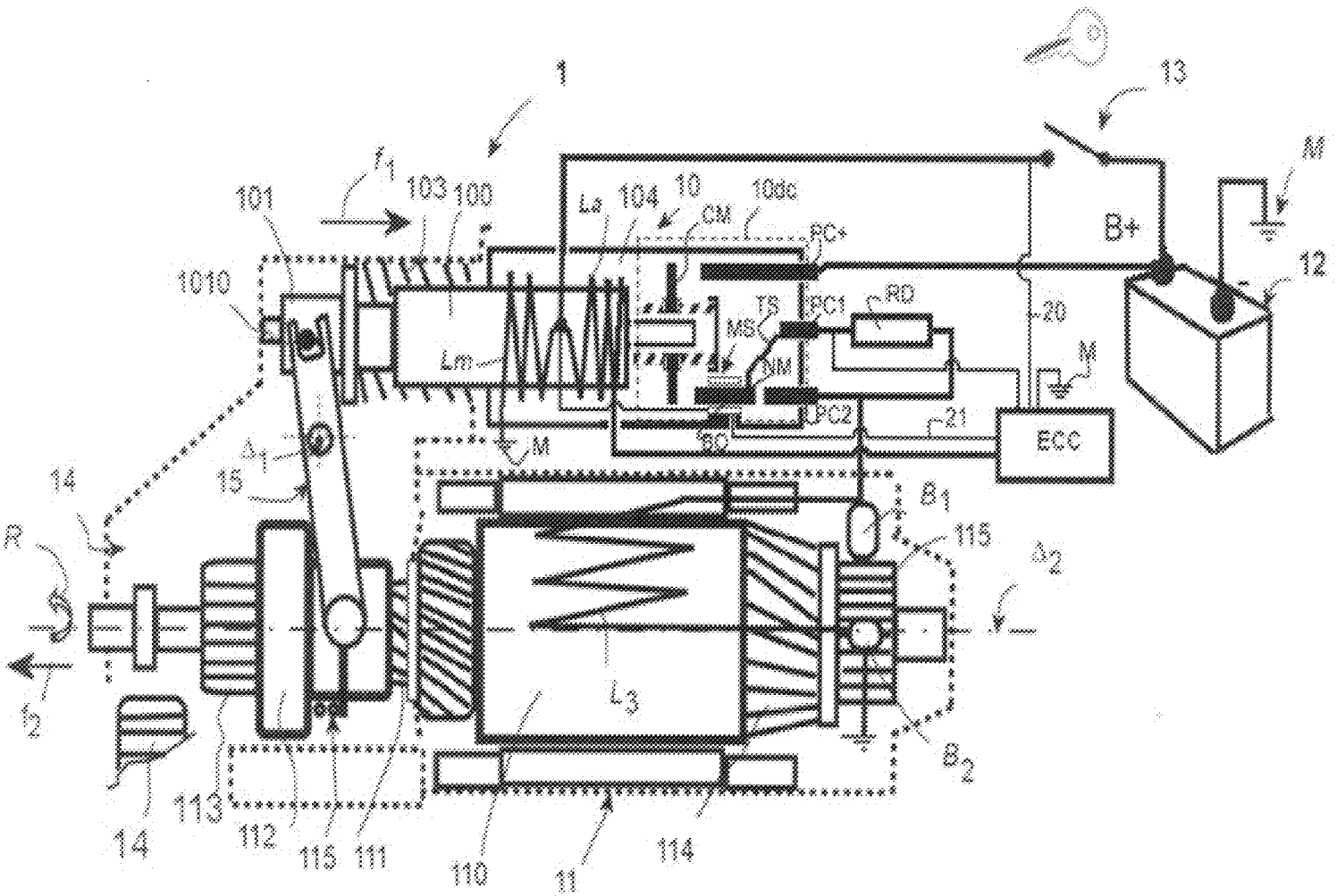
FIG. 2 schematically illustrates a particular embodiment of the starter comprising a double contact contactor according to the invention.

As it appears in FIG. 2, there are three principal components of a starter with electromagnetic control, henceforth referenced 1, namely a contactor, henceforth referenced 10, with its plunger core 100, the motor 11 and the mechanical coupling constituted by the fork 15. However, in accordance with the invention, the contactor 10 exhibits particular double contact features which will be described hereinafter. Moreover, an electronic control device ECC is provided for the operating contactor 10.

As already described above with reference to FIG. 1 for the starter 1*a* of the prior art, the various components of the starter 1 according to the invention are supplied with electric power by a battery 12. In the starter 1, the battery 12 additionally to the windings, $L_a$, $L_m$ and $L_3$, also supplies the electronic control device ECC.

As shown in FIG. 2, the contactor 10 comprises a double contact device 10*dc* which differs very substantially from the double contact device according to the prior art in FIG. 1.

The double contact device 10*dc* primarily comprises a moving contact plate CM, an electrically controllable micro-actuator in the form of a micro-solenoid MS, and three contacts PC+, PC1 and PC2.

The moving contact plate CM is actuated in a translational manner by the rear end of the plunger core 100 and is designed to establish galvanic contact between the contact PC+ and a moving electromagnetic core NM of the micro-solenoid MS.

The micro-solenoid MS is schematically illustrated on FIG. 2 in order to facilitate comprehension of the operation of the double contact device 10*dc*. In this schematic illustration, it will be considered that the moving core NM is constructed for example from soft iron so that it has electromagnetic properties and electrical conductivity. In fact, as described below in detail with reference to FIGS. 5 and 6A-6C in respect to a practical embodiment, the micro-solenoid MS comprises a stirrup contact, for example made of copper, for the passage of electric power to the starter 1.

Again with reference to FIG. 2, the moving core NM is electrically connected to the contact PC1 by an electrically conductive braid TS. The braid TS is preferably made of copper. The micro-solenoid MS comprises an electrical coil BO, one end of which is connected to the common end of the windings $L_a$ and $L_m$ which is connected to the terminal B+ of the battery 12. The other end of the coil BO is connected to a connection terminal (not referenced) of the electronic control device ECC.

The contact PC+ is connected to the terminal B+ of the battery 12. The contact PC1 is connected to a connection terminal (not referenced) of the electronic control device ECC and to the brush B1 through the current limit resistance RD. The contact PC2 on its part is directly connected to the brush B1.

The electronic control device ECC is supplied with electrical power once the starting contact 13 is closed, via a connection 20 allowing connection to the terminal B+ of the battery 12. The electronic control device ECC is also connected to the winding $L_a$, through a connection 21, and controls the excitation of the latter by allowing a connection to the mass M of the end of the winding $L_a$ besides that connected to the common end of the windings $L_a$ and $L_m$.

Figures 3A, 3B, 3C:
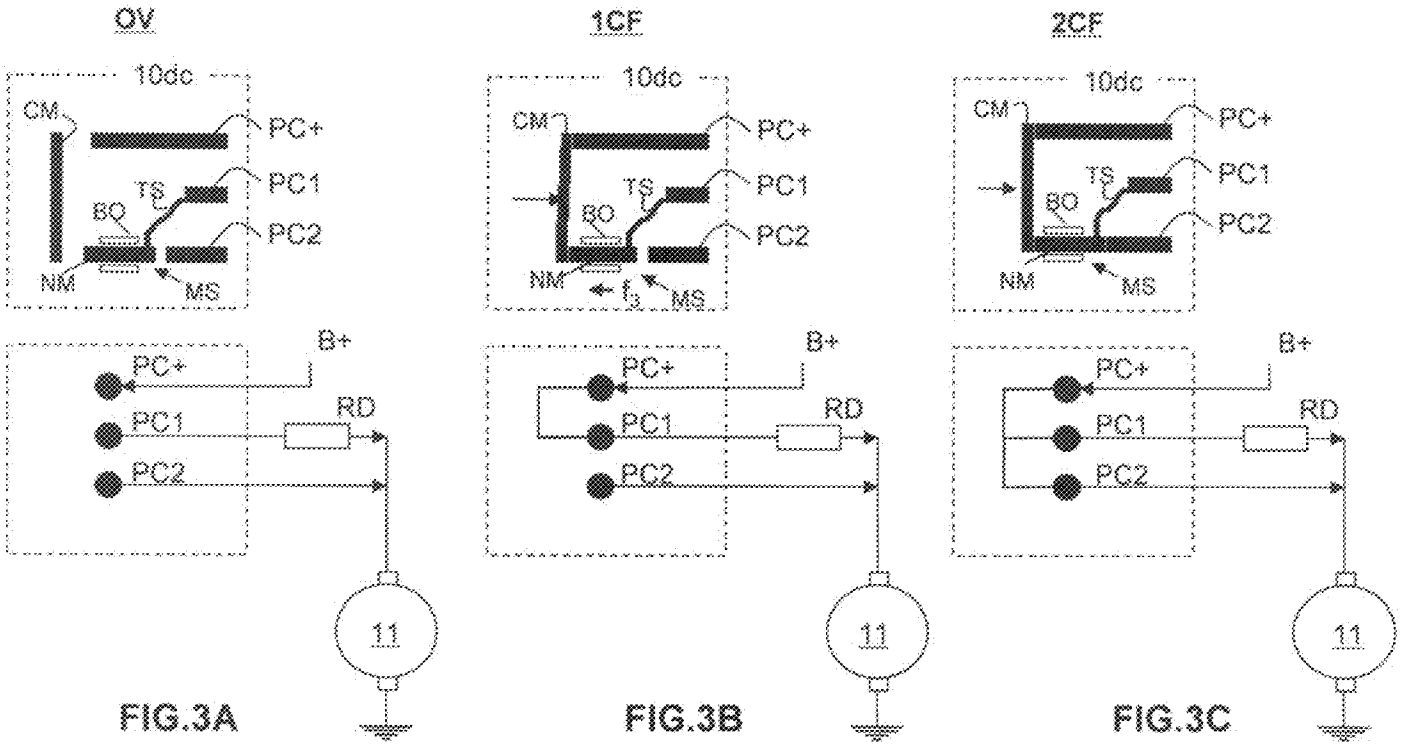
FIGS. 3A, 3B and 3C schematically illustrate various states of opening/closing of a double contact device of the starter in FIG. 2 and the corresponding states of a power circuit supplying the electric motor of the starter.

Operation of the double contact device 10*dc* is now described more particularly with reference to FIGS. 3A-3C which are schematic drawings intentionally simplified in order to facilitate the reader's comprehension.

In FIG. 3A, the double contact device 10*dc* is shown in an open state designated "state OV" hereinafter. This state corresponds to the non-activation of the starting contact 13. In this open state of the double contact device 10*dc*, the electric motor 11 is energised, no electrical connection being established between the contact PC+ connected to the terminal B+ of the battery 12 and one or other of the contacts PC1, PC2. The moving contact plate CM is maintained in its at-rest state by the core return spring 103 (FIG. 2). The micro-solenoid MS is not excited and the moving core NM is also in its at-rest state.

In FIG. 3B, the double contact device 10*dc* is shown in a first closed state, namely in a "1st contact closed" state, designated "state 1CF" hereinafter, which corresponds to the closed state of the contact C11-C12 of the prior art shown in FIG. 1.

In this state 1CF, the starting contact 13 has been and is maintained closed. The moving contact plate CM is pushed in a translational manner by the plunger core 100 and ensures electrical contact between the contact PC+ and the moving core NM. The moving core NM being connected to the contact PC1 through the braid TS, electrical contact between the contact PC+ and the contact PC1 is therefore ensured. The coil BO of the micro-solenoid MS is excited here and the core NM exerts a force $f_3$ counteracting the thrust of the moving contact plate CM, as shown in FIG. 3B where the plate CM is illustrated slightly askew. Excitation of the coil BO therefore prohibits the translational movement of the moving core NM and the electrical circuit between the contacts PC+ and PC2 remains open. An electrical connection is only established between the contact PC+ and the contact PC1 and the electric motor 11 is supplied with reduced power through the current limit resistance RD.

In FIG. 3C, the double contact device 10*dc* is shown in a second closed state, namely in a "2nd contact closed" state, designated "state 2CF" hereinafter, which corresponds to the closed state of the contact C21-C22 of the prior art shown in FIG. 1.

In this state, the starting contact 13 is always closed. Excitation of the coil BO has been interrupted and the moving core NM pushed by the plate CM therefore comes into contact with the contact PC2. An electrical connection is then established between the contact PC+ and the contacts PC1 and PC2. The contact PC2 being directly connected to the electric motor 11, the latter is supplied with full power.

The design of the double contact device 10*dc* according to the invention allows an adjustable interval between the state 1CF and the state 2CF, the change from the first state to the second state being controlled by de-energising the micro-solenoid MS, itself controlled by the electronic control device ECC.

Figure 4A:
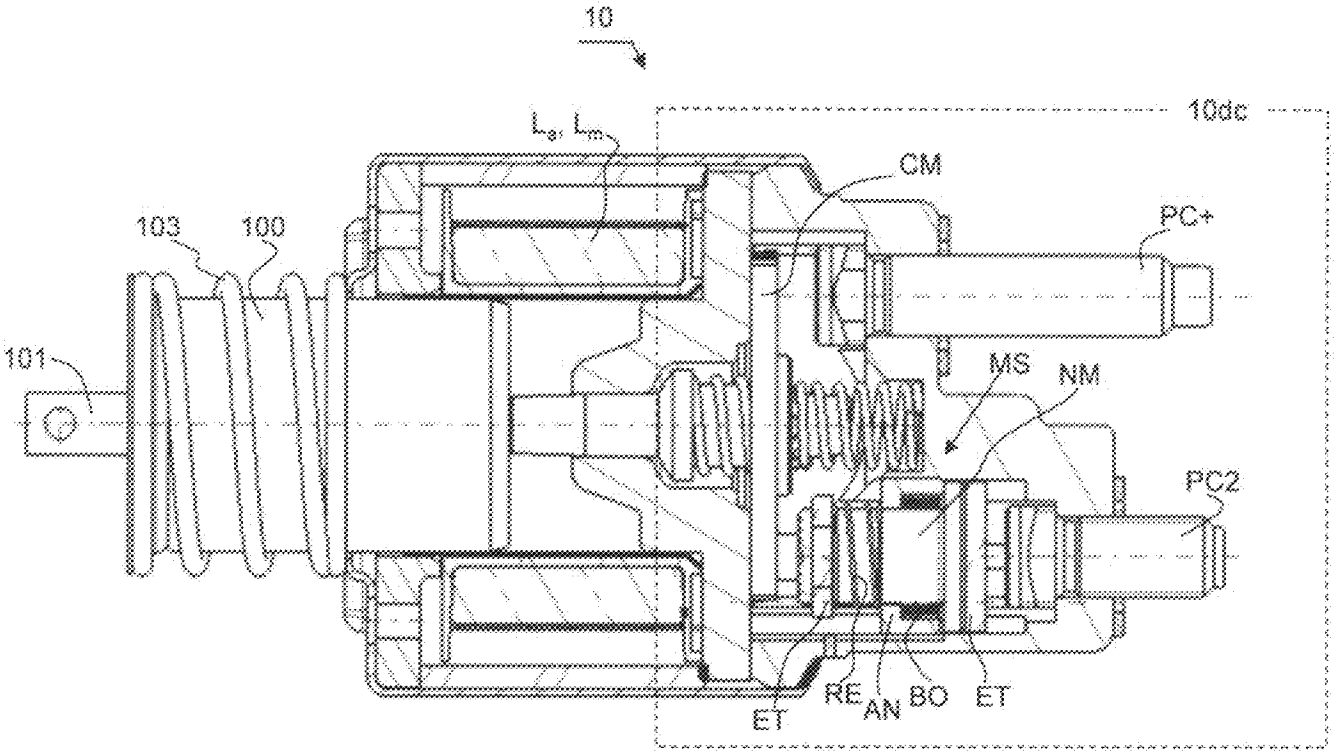
FIGS. 4A and 4B are cross-sectional views of a particular embodiment of a double contact contactor used in a starter according to the invention.
Figure 4B:
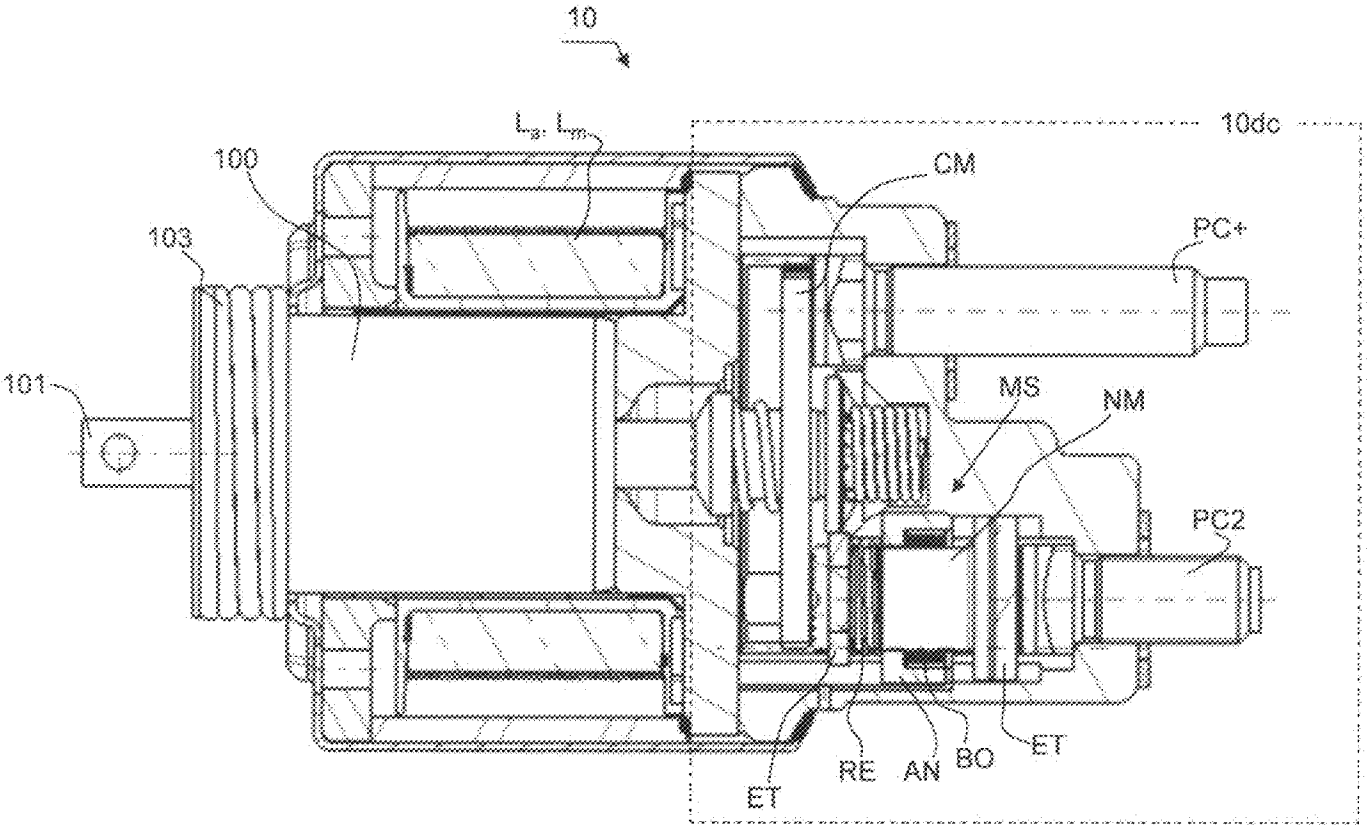

A practical embodiment of the contactor 10 according to the invention is shown in FIGS. 4A and 4B in the open state OV and the 2nd contact closed state 2CF described with reference to FIGS. 3A and 3C. The contactor 10 is illustrated in longitudinal section in FIGS. 4A and 4B so as to show the position of the micro-solenoid MS in the latter. The various functional components of the double contact device 10*dc* appear in FIGS. 4A and 4B, except for the contact PC1.

The micro-solenoid MS is now described in detail with reference to FIGS. 5, 6A, 6B and 6C.

Figure 5:
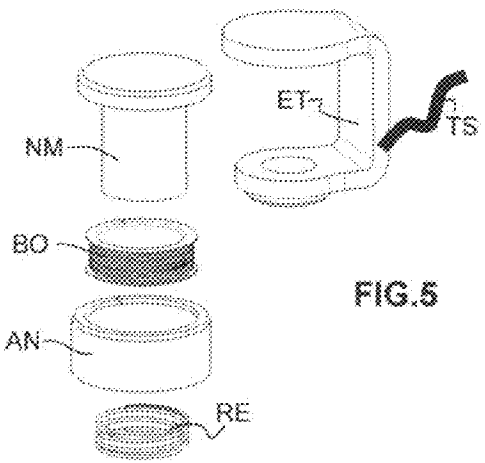
FIG. 5 is a perspective exploded view for a particular embodiment of a micro-solenoid used with the contactor in FIGS. 4A and 4B.

As shown in FIG. 5, the micro-solenoid MS comprises, in addition to the coil BO and the moving core NM, a tank AN forming coil housing and belonging to the electromagnetic circuit, a stirrup contact ET made of copper for the passage of electric power and a return spring RE.

The tank AN comprises an interior housing (visible in FIGS. 4A and 4B) where the coil BO is accommodated. The tank AN, containing the coil BO, and the spring RE are inserted in the moving core NM and the unit is placed between upper and lower jaws of the stirrup contact ET. One end of the braid TS, made of copper, is fixed to the stirrup contact ET, the other end of the latter being connected to the contact PC1. Assembly by squeezing the moving core NM between the jaws of the stirrup contact ET enables all the parts of the micro-solenoid MS to be mechanically held together.

Figure 6C:
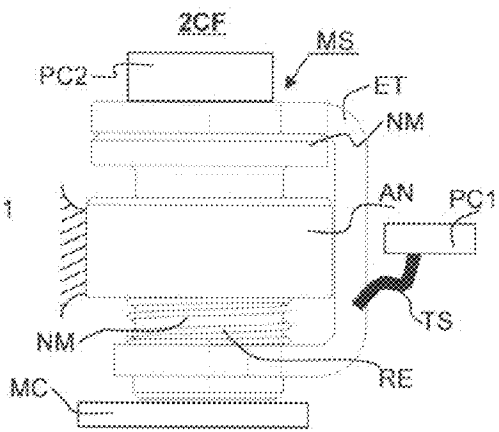
FIGS. 6A, 6C and 6B show work/rest states of the micro-solenoid in FIG. 5.
Figure 6B:
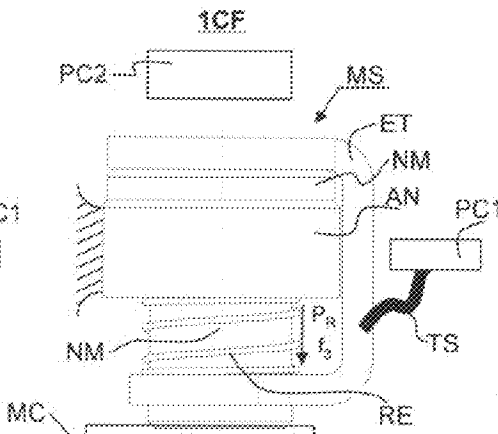
Figure 6A:
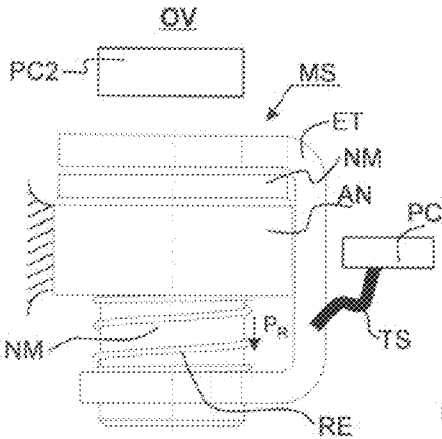

As it appears in FIGS. 6A, 6B and 6C, assembly and mechanical positioning of the micro-solenoid MS in the double contact device 10*dc* are ensured via the tank AN which is integrally joined with a wall of the device 10*dc*.

FIG. 6A shows the state of the micro-solenoid MS when the double contact device 10*dc* is in the state OV. In the state OV, the spring RE ensures a thrust $P_R$ onto the stirrup contact ET, and therefore the latter and the moving core NM are pushed downwards, with no electrical contact with the moving plate MC and the contact PC2.

FIG. 6B shows the state of the micro-solenoid MS when the double contact device 10*dc* is in the state 1CF. In the state 1CF, the coil BO is excited and the force $f_3$ applied to the moving core NM and the stirrup contact ET boosts the thrust $P_R$ of the spring RE and counteracts their displacement under the action of the moving plate CM. The core NM and the stirrup contact ET remaining in the low position, electrical contact is only ensured between the moving plate MC and the core-clamp unit NM-ET, electrically connected to the contact PC1 by the braid TS.

FIG. 6C shows the state of the micro-solenoid MS when the double contact device 10*dc* is in the state 2CF. In the state 2CF, the coil BO is no longer excited. The thrust $P_R$ of the spring RE is not sufficient to counteract the displacement of the core NM and the stirrup contact ET under the action of the moving plate MC. The core NM and the stirrup contact ET come into the upper position and electrical contact is then ensured between the moving plate MC and the contacts PC1 and PC2, by means of the core-clamp unit NM-ET and the braid TS.

The electronic control device ECC is now described in detail with reference to FIGS. 7, 8A, 8B and 8C.

Taking into account the moderate number of electronic components used in the device ECC, it will be noted that the latter can be placed inside a contactor cap 10. In addition, it will be noted that in certain embodiments of the invention, the device ECC could be implemented in the form of an ASIC.

Figure 7:
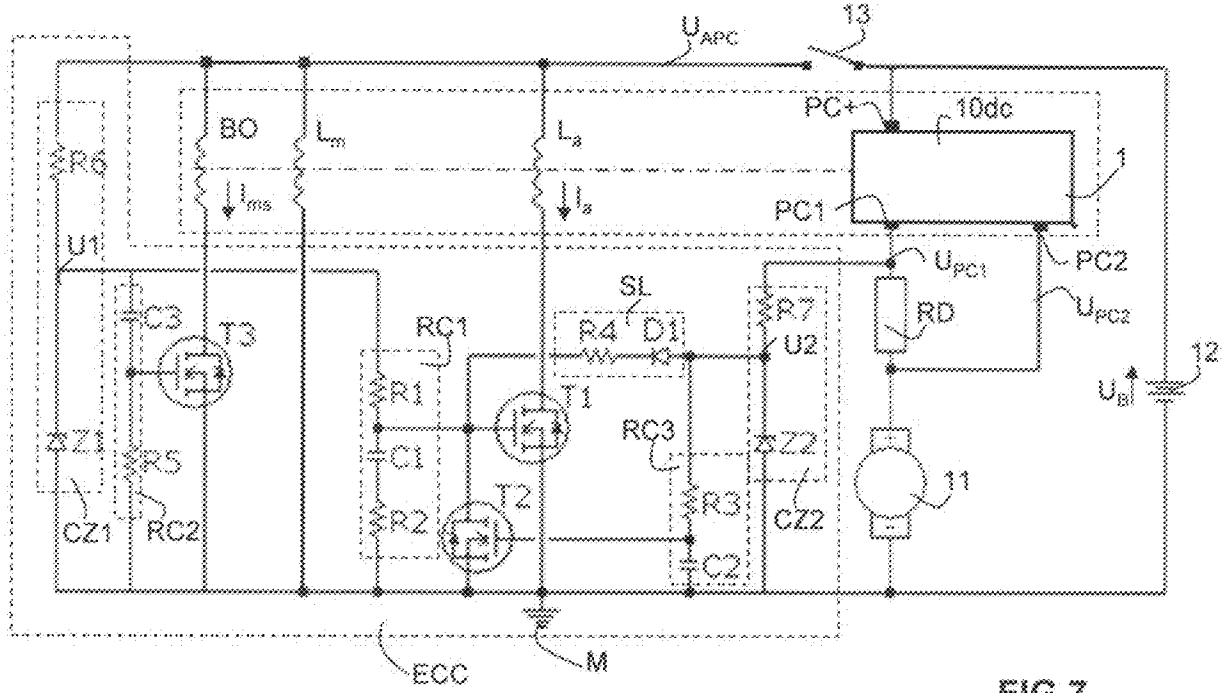
FIG. 7 is a block diagram of a particular embodiment of an electronic control device included in the starter according to the present invention.

As shown in FIG. 7, the electronic control device ECC in this particular embodiment is an analogue type circuit. The device ECC primarily comprises three transistors T1, T2 and T3, two voltage stabiliser circuits CZ1 and CZ2, three time-constant circuits RC1, RC2 and RC3 and a commutation locking circuit SL. Transistors T1, T2 and T3 here are of the MOSFET type. The transistors T1 and T3 control the excitation of the pull-in winding $L_a$ and the coil BO, respectively.

A drain electrode of the transistor T1 is connected to the end of the winding $L_a$ besides that connected to the common end of the windings $L_a$ and $L_m$. A source electrode of the transistor T1 is connected to the mass M.

A drain electrode of the transistor T3 is connected to the end of the coil BO besides that connected to the common end of the windings $L_a$ and $L_m$. A source electrode of the transistor T3 is connected to the mass M.

The transistor T2, as will appear more succinctly in the continuation of the description, is designed to force the opening of the transistor T1 by connecting the grid of the latter to the mass M after the excitation of the winding $L_a$ has ended. The transistor T2 comprises source and drain electrodes connected to the grid of the transistor T1 and the mass M respectively.

The voltage stabiliser circuits CZ1 and CZ2 are traditional circuits with Zener diodes.

The circuit CZ1 is formed by a resistance R6 and a Zener diode Z1 and provides a stabilised voltage U1. The voltage U1 is produced based on a voltage $U_{APC}$ which is available for the device ECC after the starting contact 13 has closed. The voltage $U_{APC}$ therefore corresponds to the voltage $U_B$ of the battery 12 after the starting contact 13 has closed.

The circuit CZ2 is formed by a resistance R7 and a Zener diode Z2 and provides a stabilised voltage U2. The voltage U2 is produced based on a voltage $U_{PC1}$ available on the contact PC1 in the state 1CF of the double contact device 10*dc*. The voltage $U_{PC1}$ therefore corresponds to the voltage $U_B$ when the latter becomes available on the contact PC1.

The voltage stabiliser circuit CZ1 provides the voltage U1 to the circuits RC1 and RC2. The voltage stabiliser circuit CZ2 provides the voltage U2 to the circuits RC3 and SL.

The circuit RC1 is a RC circuit of the integrating type and comprises two resistances R1 and R2 in series with a capacitor C1. The voltage U1 is applied to a first terminal of the resistance R1, the second terminal of which is connected to a first terminal of the capacitor C1. A second terminal of the capacitor C1 is connected to a first terminal of the resistance R2, the second terminal of which is connected to the mass M. The connection point between the terminals of the resistance R1 and of the capacitor C1 is connected to the control grid of the transistor T1.

The circuit RC2 is a RC circuit of the differentiating type and comprises a capacitor C3 in series with a resistance R5. The voltage U1 is applied to a first terminal of the capacitor C3. A second terminal of the capacitor C3 is connected to a first terminal of the resistance R5, the second terminal of which is connected to the mass M. The connection point between the terminals of the capacitor C3 and of the resistance R5 is connected to a control grid of the transistor T3.

The circuit RC3 is a standard integrating RC circuit and comprises a resistance R3 in series with a capacitor C2. The voltage U2 is applied to a first terminal of the resistance R3. A second terminal of the resistance R3 is connected to a first terminal of the capacitor C2, the second terminal of which is connected to the mass M. The connection point between the terminals of the resistance R3 and of the capacitor C2 is connected to a control grid of the transistor T2.

The commutation locking circuit SL comprises a commutation diode D1 in series with a resistance R4. The voltage U2 is applied to an anode of the diode D1, a cathode of which is connected to a first end of the resistance R4. A second end of the resistance R4 is connected to the grid of the transistor T1.

Figures 8A, 8B, 8C:
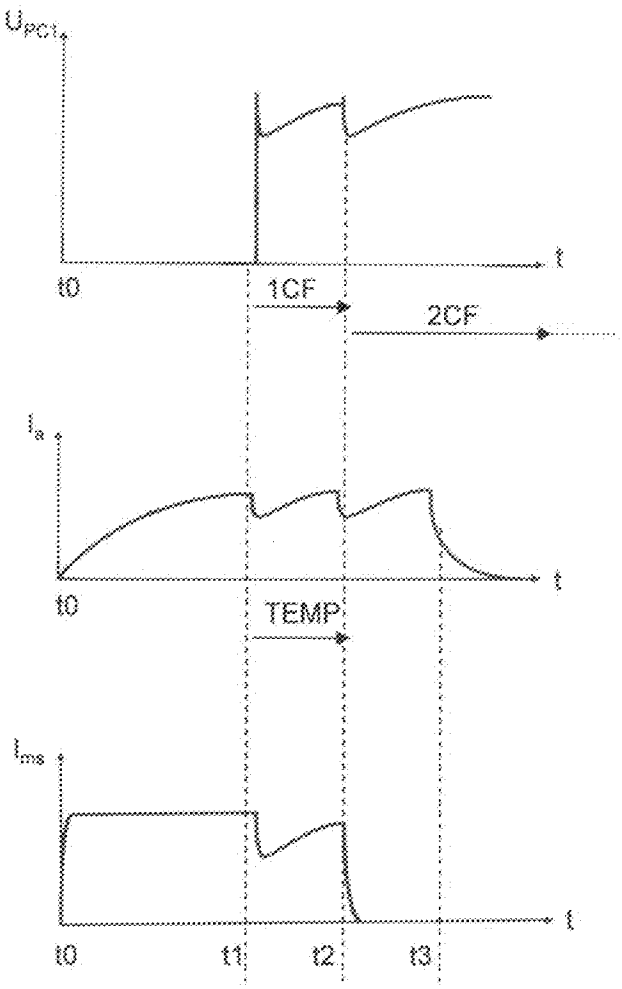
FIGS. 8A, 8B and 8C show voltage and current curves relating to the operation of the electronic control device in FIG. 7.

Operation of the device ECC is now described also with reference to the curves of FIGS. 8A, 8B and 8C.

The time t0 of the curves in FIGS. 8A, 8B and 8C corresponds to the closing of the starting contact 13.

At the time t0, the voltage $U_{APC}$ is supplied to the voltage stabiliser circuit CZ1 which applies the stabilised voltage U1 to the circuits RC1 and RC2.

The capacitor C3 of the circuit RC2 being discharged at the time t0, the voltage U1 appears on the grid electrode of the transistor T3 which changes from the open state to the closed state. As shown in FIG. 8C, a current $I_{ms}$ is then established in the coil BO of the micro-solenoid MS and excites the latter. The force $f_3$ is then applied to the moving core NM of the micro-solenoid MS.

The capacitor C1 of the circuit RC1 being discharged at the time t0, a voltage equal to U1.(R2/(R1+R2)) appears on the grid of the transistor T1. It will be noted that the transistor T2 is then in the open state, no voltage being applied to its grid. The transistor T1 gradually commutates from the open state to the closed state as its grid voltage increases with the load of the capacitor C1. The diode D1, then polarised in reverse, prevents the passage of a current to the mass M through the circuit SL, current which would disturb the load of the capacitor C1. As shown in FIG. 8B, a current $I_a$ is gradually established in the pull-in winding $L_a$, the rate of increase in this current $I_a$ being substantially determined by the time constant (R1+R2).C1 of the circuit RC1.

Excitation of the winding $L_a$ by the current $I_a$ causes the displacement of the moving core 100 of the contactor 10 and the double contact device 10*dc* commutates to the state 1CF at the time t1. Commutation of the double contact device 10*dc* to the state 1CF causes the voltage $U_{PC1}$ to appear on the contact PC1, as shown in FIG. 8A.

At the time t1, the voltage $U_{PC1}$ energises the voltage stabiliser circuit CZ2 which then provides the stabilised voltage U2 to the commutation locking circuit SL and to the circuit RC3.

Through the circuit SL, the voltage U2 causes the voltage potential in the region of the grid of the transistor T1 to increase to a value equal to U2—0.6V approximately, this amount being the voltage drop due to the diode D1. This potential increase on the grid of the transistor T1 locks the transistor T1 in the closed state and therefore prevents possible commutation rebounds.

At the time t1, the transistor T2 remains in the open state in spite of the appearance of the voltage U2, because of the time-constant R3.C2 imposed by the circuit RC3.

Still at the time t1, the motor 11 is energised by the voltage $U_{PC1}$ and starts to rotate at reduced speed. There follows a drop of the voltage $U_B$ and consecutively of the voltage $U_{PC1}$, visible in FIG. 8A, on account of the electric power supplied to the motor 11. The drop of the voltage $U_B$ due to the motor 11 also produces a weakening of the currents $I_a$ and $I_{ms}$, as shown in FIGS. 8B and 8C, but the amplitude of which remains sufficient to maintain the correct excitation of the coil BO and the winding $L_a$.

The load of the capacitor C3 started at the time t0 based on the voltage U1 continues with the time-constant R5.C5. At the time t2, shown in FIGS. 8A-8C, the charge voltage of the capacitor C3 reaches such a value that the voltage on the grid of the transistor T3 is no longer sufficient to maintain the passage of current through the latter. The transistor T3 then commutates to the open state and interrupts the current $I_{ms}$ in the coil BO, as it appears on FIG. 8C.

Interruption of the current $I_{ms}$ in the coil BO at the time t2 causes the double contact device 10*dc* to commutate from the state 1CF to the state 2CF. In the state 2CF, the contact PC2 of the double contact device 10*dc* is supplied with a voltage $U_{PC2}$ roughly equal to $U_{PC1}$ and $U_B$. The voltage $U_{PC2}$ then supplies the motor 11 with full power, starter gear 113 at this stage being meshed with toothed crown 14 of the thermal engine.

Still at the time t2, as it appears in FIGS. 8A-8C, the electric power supplying by the motor 11 causes the voltages $U_B=U_{PC1}=U_{PC2}$ to drop and the current $I_a$ in the pull-in winding $L_a$ to weaken, but the amplitude of which remains sufficient to maintain the correct excitation of the winding $L_a$.

As shown in FIG. 8B, the current $I_a$ is maintained in the pull-in winding $L_a$ until the time t3. This maintenance of the excitation of the pull-in winding $L_a$ during a period equal to t3−t2 makes it possible to be safeguarded against a possible return of the starter gear 113. Maintenance of the excitation of the pull-in winding $L_a$ until the time t3 can last a few milliseconds to a few tens of milliseconds after the time t2 depending on the applications of the invention.

The time t3 is determined by the time-constant R3.C2 of the circuit RC3. At the time t3, the charge voltage of the capacitor C2 has reached a sufficient value to control the passage of current through the transistor T2. The transistor T2 commutates to the closed state and connects the grid of the transistor T1 to the mass M. The transistor T1 then commutates from the closed state to the open state and interrupts the current $I_a$ in the winding $L_a$.

After the time t3, maintenance of the engagement of the starter gear 113 in the toothed crown 14 is ensured due to the excitation of the holding winding $L_m$ which continues for as long as the starting contact 13 remains closed.

In accordance with the invention, by adjusting the time-constant R5.C3 of the circuit RC2, it is possible to easily regulate an interval TEMP=t2−t1 between the reduced speed of the motor 11 and its full speed.

The invention claimed is:

1. A starter for a thermal engine, comprising:

a double contact electromagnetic contactor (10) comprising a solenoid actuator including a movable plunger core (100) and a pull-in winding, an electrically controllable micro-actuator including a micro-solenoid (MS) having a movable core (NM) and an electrical coil (BO), and an electronic control device (ECC);

said electronic control device (ECC) comprising first transistor commutation means (T1, T2, CZ2, RC1, RC3, SL) to control the excitation of said pull-in winding ($L_a$) of said solenoid actuator of said contactor and second transistor commutation means (T3, CZ1, RC2) to control the excitation of said electrical coil (BO) of said micro-solenoid (MS) of said micro-actuator.

2. The starter according to claim 1, wherein said second transistor commutation means (T3, CZ1, RC2) controls the excitation of said micro-actuator (MS) for a first predetermined duration (t2−t0) after activation of said electronic control device (ECC).

3. The starter as in claim 2, wherein said second transistor commutation means comprises a first RC circuit with time-constant (RC2) for said first predetermined duration (t2−t0).

4. The starter according to claim 3, wherein said first RC circuit with time-constant (RC2) is a circuit of the differentiating type.

5. The starter according to claim 3, wherein said first predetermined duration (t2−t0) is completed (t2) between commutation to start activation (t1) and commutation to end activation (t3) of said first transistor commutation means.

6. The starter according to claim 1, wherein said second transistor commutation means comprises at least one transistor of the MOSFET type.

7. The starter as in claim 1, wherein said second transistor commutation means comprise a first voltage stabiliser circuit (CZ1) supplying a first stabilised voltage (U1) feeding said second transistor commutation means.

8. The starter as in claim 1, wherein said first transistor commutation means comprise at least one transistor (T1, T2) of the MOSFET type.

9. The starter as in claim 1, wherein said first transistor commutation means comprise second and third RC circuits with time-constant (RC1, RC3) of the integrating type, said second RC circuit (RC1) controlling commutation to start activation (t1) of said first transistor commutation means and said third RC circuit (RC3) controlling commutation to end activation (t3) of said first transistor commutation means, activation of said first transistor commutation means producing the excitation of said pull-in winding ($L_a$).

10. The starter according to claim 1, wherein said double contact electromagnetic contactor (10) further comprises a movable contact plate (CM) and three contacts PC+, PC1 and PC2.

11. The starter according to claim 10, wherein said micro-solenoid (MS) is disposed between said moving contact plate (CM) and one of said three contacts PC+, PC1 and PC2.

12. The starter according to claim 11, wherein said movable core (NM) of said micro-solenoid (MS) is electrically connected to the other of said three contacts PC+, PC1 and PC2.

13. The starter according to claim 1, wherein said solenoid actuator further includes a holding winding.

* * * * *